US005154408A

United States Patent [19]

Stepan et al.

[11] Patent Number: 5,154,408

[45] Date of Patent: * Oct. 13, 1992

[54] HIGH CAPACITY SHEET FEEDER WITH ADJUSTABLE DECK

[75] Inventors: Constance R. Stepan, Derby; James A. Spiers, Norwalk, both of Conn.

[73] Assignee: Pitney Bowes Inc., Stamford, Conn.

[ * ] Notice: The portion of the term of this patent subsequent to Feb. 18, 2009 has been disclaimed.

[21] Appl. No.: 635,035

[22] Filed: Dec. 28, 1990

[51] Int. Cl.[5] ..... B65H 3/52

[52] U.S. Cl. ..... 271/121; 271/126; 271/149; 271/161; 271/162; 271/171

[58] Field of Search ..... 271/161, 147, 149, 171, 271/150, 126, 121, 162

[56] References Cited

U.S. PATENT DOCUMENTS

| | | | |
|---|---|---|---|
| 607,958 | 7/1898 | Schilz | 271/161 X |
| 1,047,689 | 12/1912 | Nind et al. . | |
| 1,419,733 | 6/1922 | Hitchcock | 271/161 X |
| 1,566,163 | 12/1925 | Neihart . | |
| 1,850,108 | 3/1932 | Hunter et al. | 271/161 |
| 2,227,643 | 1/1941 | Hageman | 271/161 X |
| 2,693,957 | 11/1954 | Welsh | 271/149 X |
| 2,779,593 | 1/1959 | Doerner | 271/126 X |
| 3,185,472 | 5/1965 | Rubow | 271/149 X |
| 3,598,399 | 10/1971 | Cottrell | 271/149 X |
| 3,741,537 | 6/1973 | Lange | 271/147 |
| 3,958,800 | 5/1976 | Gates | 271/149 X |
| 3,989,236 | 11/1976 | Komori et al. | 271/9 X |
| 4,007,925 | 2/1977 | De Ryke et al. | 271/126 X |
| 4,184,670 | 1/1980 | Rosendahl | 271/12 |
| 4,362,100 | 12/1982 | Wu et al. | 101/233 |
| 4,530,260 | 7/1985 | Prewer | 271/149 X |
| 4,869,486 | 9/1989 | Scarpa et al. | 271/150 X |
| 5,004,219 | 4/1991 | Godlewski | 271/149 X |
| 5,088,718 | 2/1992 | Stepan et al. | 271/149 X |

FOREIGN PATENT DOCUMENTS

| | | | |
|---|---|---|---|
| 1238045 | 4/1967 | Fed. Rep. of Germany | 271/126 |
| 40331 | 3/1985 | Japan | 271/162 |

*Primary Examiner*—Robert P. Olszewski
*Assistant Examiner*—Boris Milef
*Attorney, Agent, or Firm*—Charles R. Malandra, Jr.; Melvin J. Scolnick

[57] ABSTRACT

Apparatus for feeding and separating seriatim a sheet of paper from a stack of sheets. The apparatus includes: an adjustable deck having a receiving end and a feeding end for supporting the stack of sheets on edge, the deck being oriented at an angle between about 10 and 20 degrees to a horizontal plane and wherein the feeding end is lower than the receiving end; a main urge roller situated above the feeding end of the deck sheets; a secondary feed roller parallel to and situated above the main urge roller near the top edge of the stack of sheets, wherein a line of tangency joining the peripheries of the main urge roller and the feed roller adjacent the stack of sheets is disposed at an angle between about 40 and 50 degrees to a horizontal plane; a device for urging the stack against the main urge roller as the stack is reduced in the course of the feeding of the sheets seriatim; a device downstream of the secondary feed roller for separating the bottom sheet from the stack of sheets at the top edge of the stack; and a device for adjusting the height of the adjustable deck without changing the angle of orientation of the deck whereby the deck can be set to the optimum height for feeding a given size sheet.

8 Claims, 4 Drawing Sheets

HIGH CAPACITY SHEET FEEDER WITH ADJUSTABLE DECK

The instant invention relates to apparatus for feeding and separating sheets of paper from a stack of sheets, and more particularly to such a sheet feeder which can accommodate a variety of sizes and has a large, loading capacity.

Sheet feeders take sheets from a stack, one unit at a time, and find practical use in connection with systems where a sheet of paper is to be put into an envelope. Usually, the sheets of paper are stacked in a unit and manually placed in a holding device. From this holding device the sheets are conveyed in one way or another to the envelope, where they are inserted into the envelope by machine. This insertion is desired to be performed as quickly and as safely as possible.

Stacks for feeding sheets can be oriented in a variety of directions to achieve particular, desired objectives. Feeding from the bottom of a stack offers the advantage of a constant feed location not requiring any supplemental devices to position the sheet being fed. However, typically there is a limit to the size of a stack that can be used for bottom feeding because at a certain point the pressure and weight becomes too great for effective, efficient feeding and separation.

In co-pending application Ser. No. 622,906 filed Dec. 6, 1990, now U.S. Pat. No. 5,088,718 by the assignee of the instant invention, entitled "High Capacity Sheet Feeder", there is disclosed a high capacity sheet feeder which achieves the advantages of bottom feeding but without the limitation of small loading capacity usually associated with bottom feeding. The instant invention provides an improvement in the "High Capacity Sheet Feeder" by providing an adjustable loading deck which enables the sheet feeder to be adjusted in order to feed different sizes of paper sheets.

SUMMARY OF THE INVENTION

Accordingly, the instant invention provides apparatus for feeding and separating seriatim a sheet of paper from a stack of sheets. The apparatus comprises: an adjustable deck having a receiving end and a feeding end for supporting said stack of sheets on edge, said deck oriented at an angle between about 10 and 20 degrees to a horizontal plane and wherein said feeding end is lower than said receiving end; a main urge roller situated above the feeding end of the deck ; a secondary feed roller parallel to and situated above the main urge roller near the top edge of the stack of sheets, wherein a line of tangency joining the peripheries of the main urge roller and the feed roller adjacent the stack of sheets is disposed at an angle between about 40 and 50 degrees to a horizontal plane; means for urging the stack against the main urge roller as the stack is reduced in the course of the feeding of the sheets seriatim; means downstream of the secondary feed roller for separating the bottom sheet from the stack of sheets at the top edge of the stack; and means for adjusting the height of the adjustable deck without changing the angle of orientation of the deck whereby the deck can be set to the optimum height for feeding a given size sheet.

DETAILED DESCRIPTION OF THE PREFERRED EMBODIMENT

Figure 1:
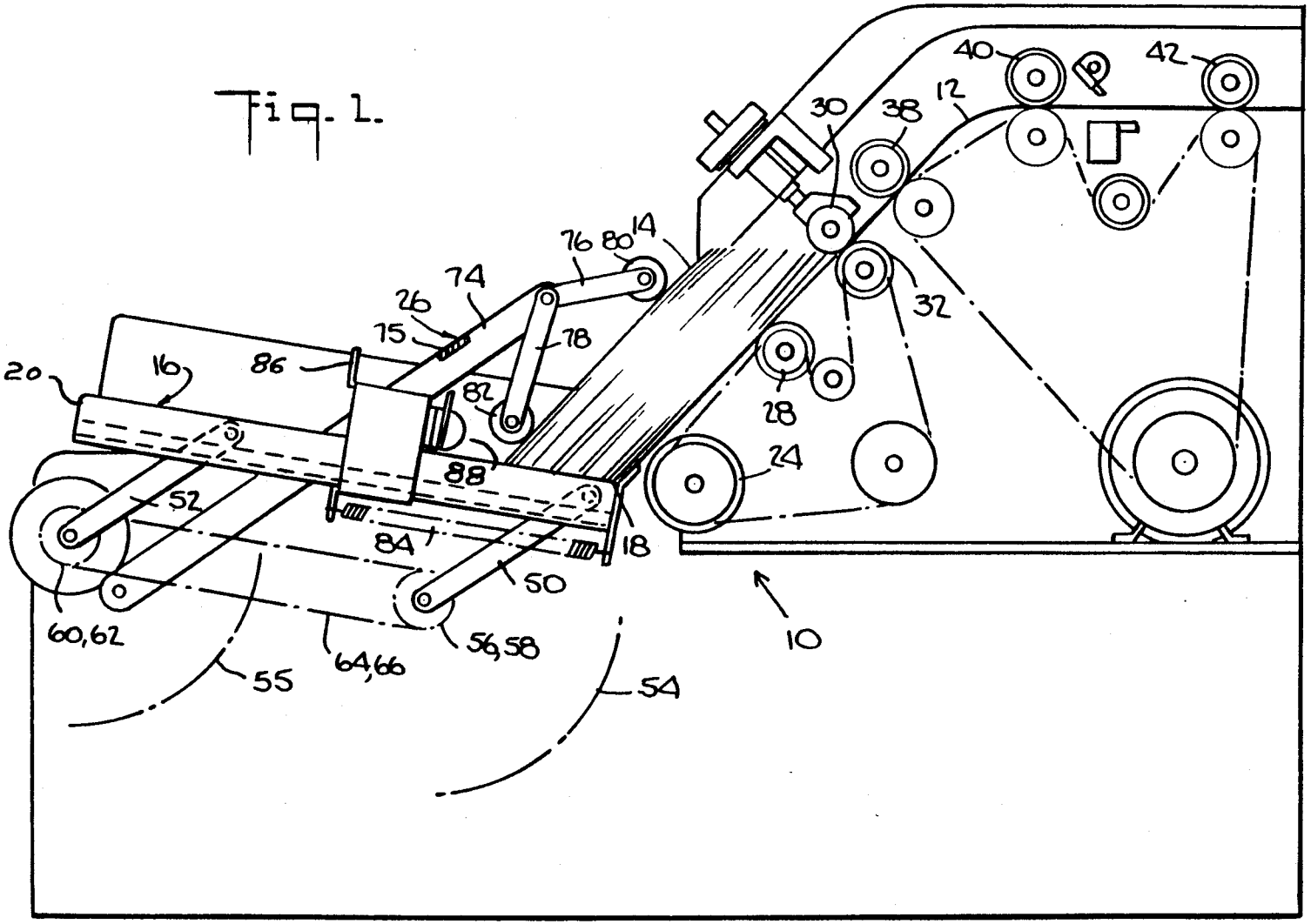
FIG. 1 is a side, elevational view of a high capacity sheet feeder in accordance with the instant invention, showing the feed deck set for seven inch long paper.

In describing the preferred embodiment of the instant invention, reference is made to the drawings, wherein there is seen a sheet feeding and separating device generally designated 10 for feeding and separating seriatim a sheet 12 from a stack of sheets 14. The sheet feeder 10 includes an adjustable deck 16 which is oriented at an angle of 15° to the horizontal in order to support the stack of sheets 14 on edge. The lower end of the deck 16 is the feeding end 18, while the higher end of the deck 16 is the receiving end 20. The entire stack of sheets 14 bends at a 43° angle over a main urge roller 24 (as explained further hereinbelow). This orientation allows a large loading capacity with minimal influence of stack pressure at separation points. Most of the stack weight distributes on the deck 16. Natural separation begins after the bend by a slight fanning of the stack 14 at the top.

Figure 2:
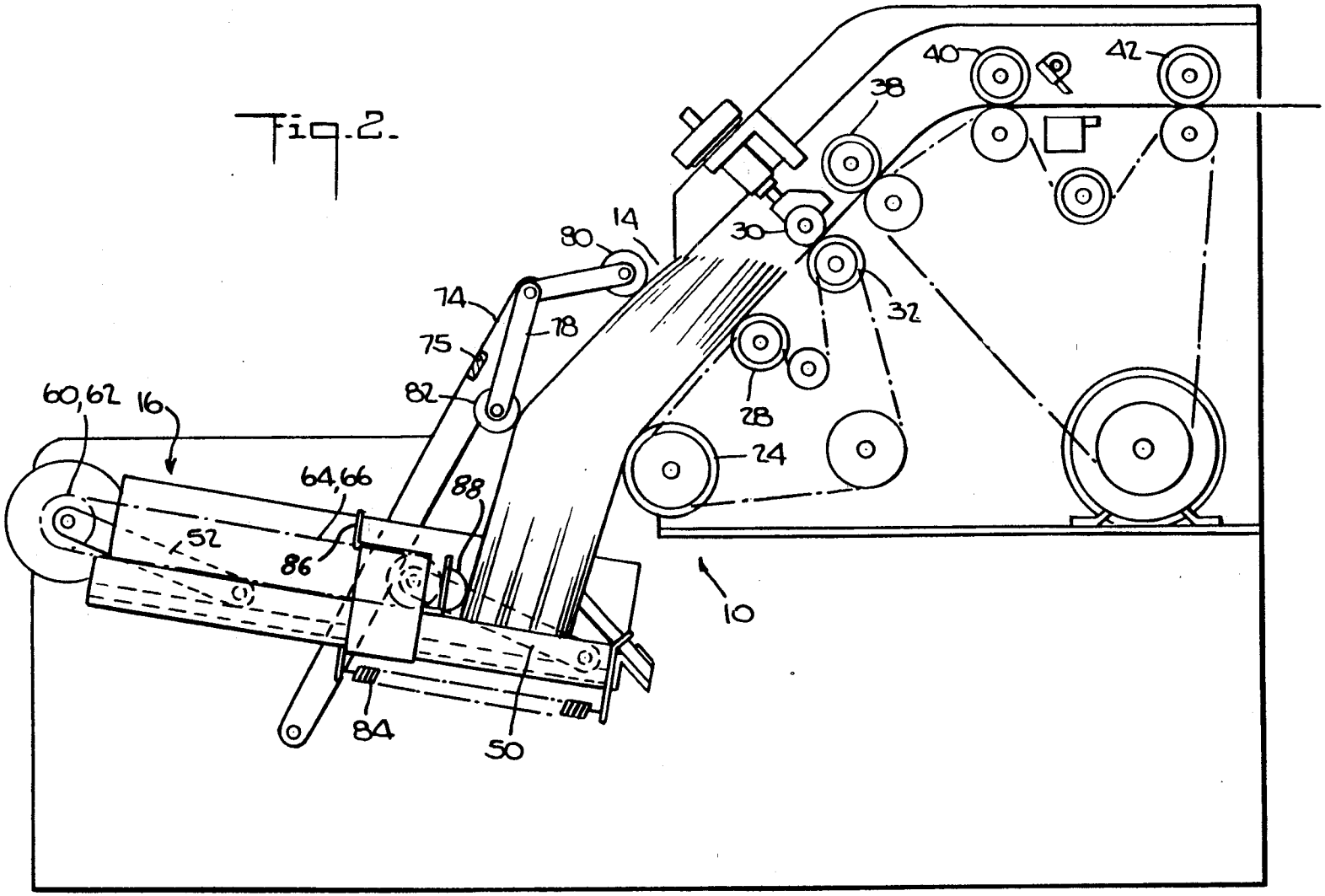
FIG. 2 is similar to FIG. 1 except that the deck is shown set for 11 inch long paper.

The deck 16 sits at the aforementioned 15° slant mounted by a linkage system shown in FIG. 2. Because of the slant, gravity maintains a positive force at the feeding end of the stack of sheets 14. A spring loaded guide 26 contacts the stack 14 at the receiving end (back along the bottom, at the bending point and close to the top, depending on the height of the paper being fed. The spring guide 26 advances the entire stack 14 forward toward the main urge roller 24 as the stack 14 decreases. When the stack 14 becomes very small, extra force on the stack 14 is needed to feed the last sheets 12, and the guide 26 supplies the needed force. The guide 26 is also necessary to support longer sheets 12 in the correct position.

The main urge roller 24 is situated above the feeding end 18 of the deck 16 along a line which is at about the midway point between the top and bottom edges of the stack of sheets 14. A secondary feed roller 28 is parallel to and situated above the main urge roller 24 near the top edge of the stack of sheets 14. A line of tangency joining the peripheries of the main urge roller 24 and the secondary feed roller 28 adjacent the stack of sheets 14 is disposed at a 43 degree angle to the horizontal, i.e. this line of tangency is parallel to the plane of the protective plate 22. The stack of sheets 14 rests against the main urge roller 24 and the secondary feed roller 28, and thus lies at a 43 degree angle to the horizontal.

Separation of a sheet 12 from the stack of sheets 14 is effected by the main urge roller 24, the secondary feed roller 28 and a cooperating stone 30 and feed roller 32. Adjustable side guides 34 and 36 force the sheets 12 to run in a straight path. A clutch controls the stopping and starting of the rollers.

Following separation at the stone 30, the sheets 12 enter a removal section consisting of three long roller sets 38, 40 and 42, where the paper path curves to a horizontal position, preparatory for further processing.

One motor (not shown) drives the entire sheet feeder 10; the removal section consisting of the roller sets 38, 40 and 42 runs continuously, while the separation section consisting of the main urge roller 24, the secondary roller 28, the stone 30 and the cooperating feed roller 32 feeds upon demand.

In operating the aforesaid sheet feeding apparatus 10, the sheets 12 are loaded onto the deck 16 so that the stack 14 is formed against the rollers 24 and 28. The side guides 34 and 36 keep the stack 14 in line. A clutch engages the separation section and the rollers 24, 28 and 32 all start. Because the top of the stack 14 is slightly fanned, little friction is present between individual sheets 12 there. Friction between the main urge roller 24 and the paper 12 is greater than between two pieces of paper 12 at the bending point. The main urge roller 24 forces the paper 12 up towards the stone 30. Gravity aids in keeping the remaining sheets 12 in the stack 14 in place. A pre-set gap between the stone 30 and the roller 32 allows only one sheet of paper 12 into the nip therebetween.

After one sheet 12 is through the stone 30 and into the nip of the take away rollers 38, the clutch disengages. The take away rollers 38 are running at a higher speed and they pull the sheet 12 away from the stack 14. The roller 32 under the stone 30 contains a one way bearing to eliminate drag. The main urge roller 24 becomes stationary and holds the remaining sheets 12 in place. After the sheet 12 exits and the system is ready, the clutch engages again and another sheet 12 feeds.

Although the deck 16 is seen as oriented at an angle of 15°, a range between 10° and 20° is functional, although a more limited range between 12° and 18° is preferred. The tangency line between the rollers 24 and 28 is seen as oriented at an angle of 43°.to the horizontal, and although a range of 40° to 50° is functional, a more limited range between 42° and 47° is preferred.

As indicated hereinabove, the deck 16 can be adjusted to whatever height is desired depending upon the size of the paper sheets 12 being fed. The deck 16 is rotatably mounted on a linkage system (described in detail hereinbelow) which can raise or lower the deck in a curved path. This arc uniquely orients each length of paper 12 to distribute its own stack weight appropriately. The deck 16 is rotatably mounted on a pair of forward swingable arms 50 and 51 and a pair of rearward swingable arms 52 and 53 which are rotatable throughout a pair of arcs 54 and 55 respectively. The arms 50–53 are rotatably mounted on the sides of the housing 57. Sprocket gears 56, 58, 60 and 62 are located at the ends of the arms 51, 52, 53 and 54 respectively. A chain 64 connects the gears 56 and 60, and a chain 66 connects the gears 58 and 62. The gears 60 and 62 are mounted on a shaft 68 which can be rotated by a knob 70; thus, by rotating the knob 70, the chains 64 and 66 can be rotated thereby rotating the arms 51–53 which effects the desired raising or lowering of the deck 16. A height locking device 72 allows the deck 16 to be locked into the desired height.

Figure 3:
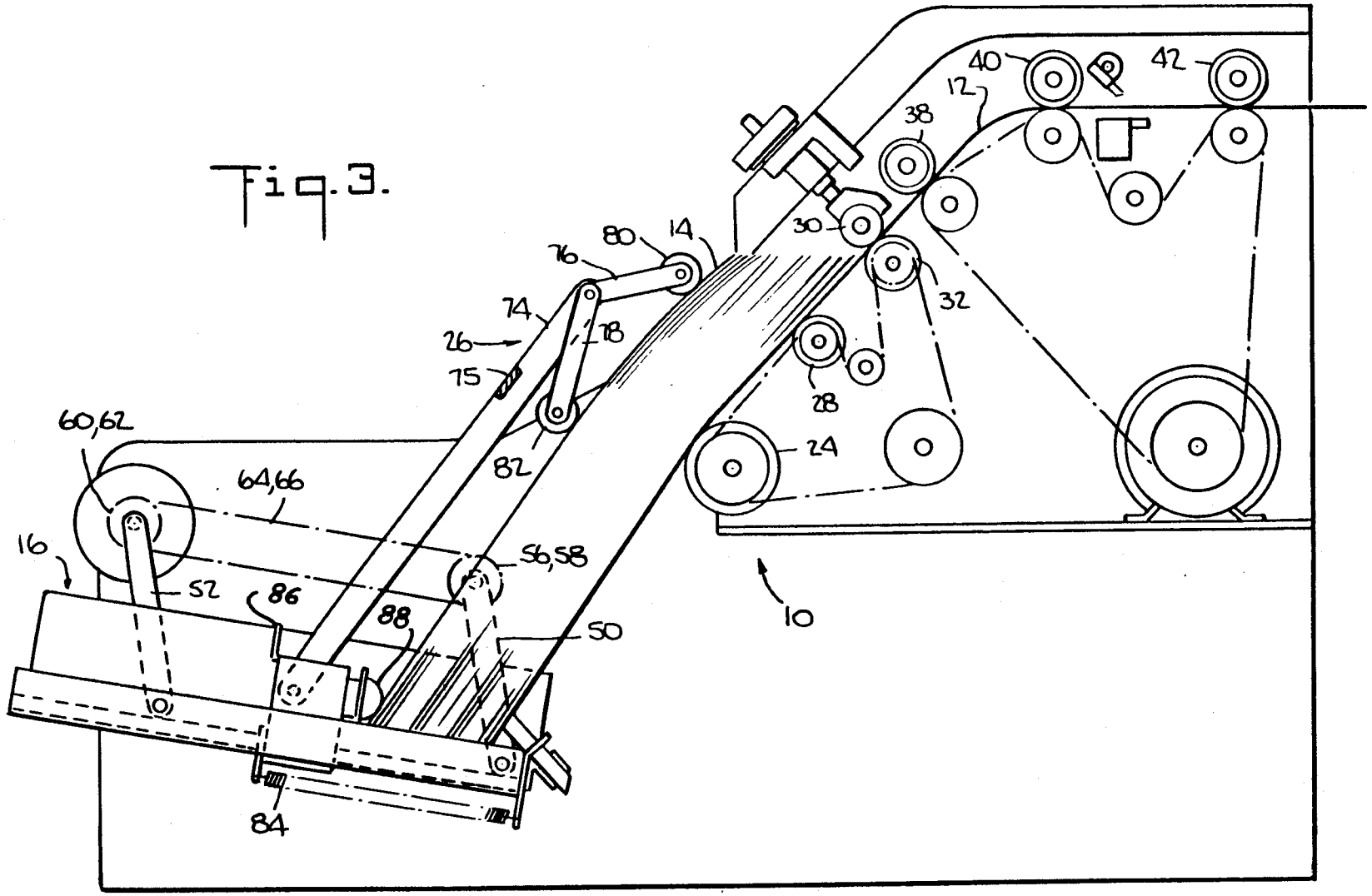
FIG. 3 is similar to FIG. 2 except that the deck is shown set for 14 inch long paper.
Figure 4:
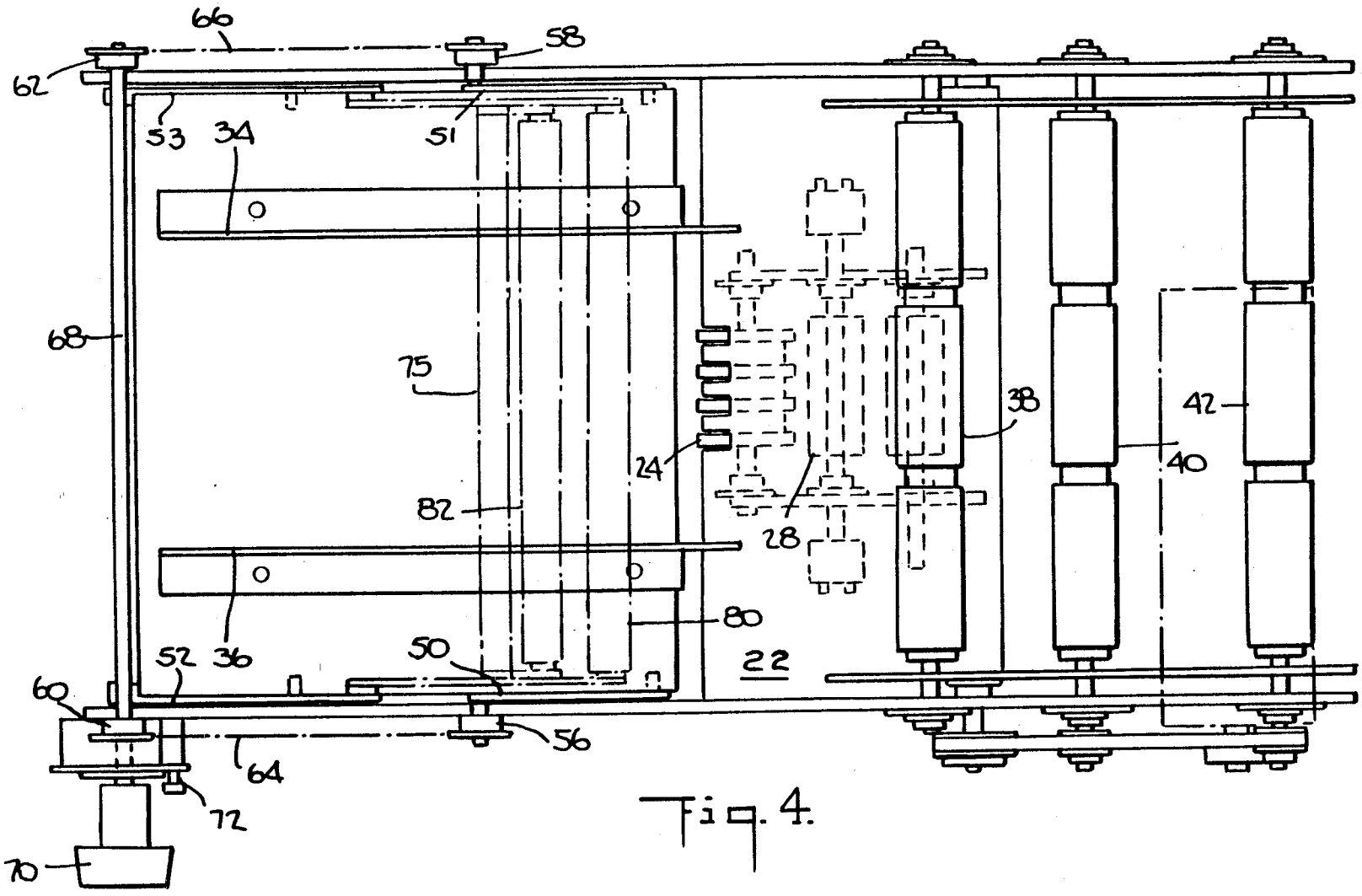
FIG. 4 is a top, plan view of the apparatus seen in FIG. 1.

The spring guide 26 can be set at various heights to feed various heights of paper. The guide 26 includes a pair of main arms 74 joined by a horizontal cross member 75. The arms 74 have a plurality of settings so that, with respect to the deck 16, the arms 74 can be raised for longer paper, as seen in FIG. 3, or lowered for shorter paper, as seen in FIG. 1. FIG. 2 shows an intermediate adjustment. FIG. 1 shows the settings for the deck 16 and the arms 74 for 7 inch long paper, FIG. 2 for 11 inch long paper, and FIG. 3 for 14 inch long paper. Pivotably mounted on the main arms 74 are shorter arms 76 and 78 which are fixed in position with respect to each other, so that the angle between the arms 76 and 78 remains constant at all times. Rollers 80 and 82 are rotatably mounted at the ends of the arms 76 and 78 respectively for urging contact with the stack of sheets 14. Secured to the deck 16 is a spring 84 which at its other end attaches to a handle device 86. The handle 86 has secured thereto a pusher element 88 also for urging contact with the stack of sheets 14.

It should be understood by those skilled in the art that various modifications may be made in the present invention without departing from the spirit and scope thereof, as described in the specification and defined in the apended claims.

What is claimed is:

1. Apparatus for feeding and separating seriatim a sheet of paper from a stack of sheets, comprising:

an adjustable deck having a receiving end and a feeding end for supporting said stack of sheets on edge, said deck oriented at an angle between about 10 and 20 degrees to a horizontal plane and wherein said feeding end is lower than said receiving end;

a main urge roller situated above said feeding end of said deck;

a secondary feed roller parallel to and situated above said main urge roller near the top edge of said stack of sheets, wherein a line of tangency joining the peripheries of said urge roller and said feed roller adjacent said stack of sheets is disposed at an angle between about 40 and 50 degrees to a horizontal plane;

means for urging said stack against said main urge roller as said stack is reduced in the course of said feeding of said sheets seriatim;

means downstream of said secondary feed roller for separating the bottom sheet from said stack of sheets at the top edge of said stack, said separating means comprising a separating stone and cooperating feed roller; and means for adjusting the height of said adjustable deck without changing the angel of orientation of said deck whereby said deck can be set to the optimum height for feeding a given size sheet.

2. The apparatus of claim 1, wherein said urging means comprises a spring loaded guide.

3. The apparatus of claim 2, wherein said deck angle is between about 12 and 18 degrees.

4. The apparatus of claim 3, wherein said deck angle is 15 degrees.

5. The apparatus of claim 3, wherein said angle of said line of tangency is between about 42 and 47 degrees.

6. The apparatus of claim 5, wherein said angle of said line of tangency is 43 degrees.

7. The apparatus of claim 1, wherein said height adjusting means includes a pair of forward swingable arms and a pair of rearward swingable arms, said forward and rearward swingable arms being rotatable through an arc, and wherein said deck is rotatably mounted on said forward and rearward swingable arms.

8. The apparatus of claim 2, wherein said urging means further comprises a spring loaded pusher device for urging the bottom of the stack towards the lower end of said adjustable deck when said adjustable deck is positioned for a stack of larger size sheets, whereby said stack is bent at a point where said stack contacts said main urge roller.

* * * * *